US006734766B2

(12) United States Patent
Lye et al.

(10) Patent No.: US 6,734,766 B2
(45) Date of Patent: May 11, 2004

(54) MICROWAVE FILTER HAVING A TEMPERATURE COMPENSATING ELEMENT

(75) Inventors: David J. Lye, Hemel Hempstead (GB); Ayyangar R. Harish, Luton (GB); Gerrard V. Howcroft, Biggleswade (GB)

(73) Assignee: COM DEV Ltd. (CA)

( * ) Notice: Subject to any disclaimer, the term of this patent is extended or adjusted under 35 U.S.C. 154(b) by 26 days.

(21) Appl. No.: 10/123,654

(22) Filed: Apr. 16, 2002

(65) Prior Publication Data

US 2003/0193379 A1 Oct. 16, 2003

(51) Int. Cl.[7] ..... H01P 1/20

(52) U.S. Cl. ..... 333/203; 333/206; 333/229; 333/234; 333/235

(58) Field of Search ..... 333/203, 206, 333/229, 234, 235

(56) References Cited

U.S. PATENT DOCUMENTS

| | | | | | |
|---|---|---|---|---|---|
| 2,795,764 | A | * | 6/1957 | Mittelman et al. | 333/234 |
| 4,389,624 | A | * | 6/1983 | Aihara et al. | 333/226 |
| 4,890,078 | A | * | 12/1989 | Radcliffe | 333/134 |
| 5,039,966 | A | | 8/1991 | Schmid et al. | |
| 5,208,567 | A | | 5/1993 | Bell et al. | |
| 5,216,388 | A | | 6/1993 | Dipoala | |
| 5,233,319 | A | | 8/1993 | Mizan et al. | |
| 5,304,968 | A | * | 4/1994 | Ohtonen et al. | 333/222 |
| 5,309,129 | A | | 5/1994 | Arnold et al. | |
| 5,905,419 | A | * | 5/1999 | Lukkarila | 333/202 |
| 6,057,748 | A | * | 5/2000 | Hsing et al. | 333/224 |
| 6,172,880 | B1 | | 1/2001 | Petitpierre et al. | |
| 6,362,708 | B1 | * | 3/2002 | Woods | 333/234 |
| 6,407,651 | B1 | * | 6/2002 | Wulff et al. | 333/224 |

FOREIGN PATENT DOCUMENTS

| | | | | |
|---|---|---|---|---|
| DE | 4029410 A1 | * | 3/1992 | H01P/7/06 |
| JP | 05259719 A | * | 10/1993 | H01P/7/06 |

* cited by examiner

*Primary Examiner*—Seungsook Ham
*Assistant Examiner*—Kimberly E Glenn
(74) *Attorney, Agent, or Firm*—Jones Day

(57) ABSTRACT

A microwave filter having a temperature compensating element includes a housing wall structure, a filter lid, a resonator rod, a tuning screw and the temperature compensating element. The housing wall structure defines a cavity. The filter lid closes the cavity. The resonator rod is within the cavity. The tuning screw is adjustably mounted through the filter lid and has a portion that protrudes into the cavity and is coaxial with the resonator rod. The temperature compensating element is joined to the filter lid or the housing and forms a bimetallic composite with the filter lid or housing that deforms with a change in ambient temperature.

12 Claims, 5 Drawing Sheets

MICROWAVE FILTER HAVING A TEMPERATURE COMPENSATING ELEMENT

BACKGROUND

1. Field of the Invention

This invention relates generally to the field of electronic filters. More particularly, the present invention provides a microwave filter having a temperature compensating element.

2. Description of the Related Art

Microwave filters are known in this art. A microwave filter is an electromagnetic circuit that can be tuned to pass energy at a specified resonant frequency. The filter is used in communications applications to filter a signal by removing frequencies that are outside a bandpass frequency range. This type of filter typically includes a housing with an input port and an output port. Internally, a typical microwave filter includes an array of interconnected filter cavities. In many microwave filters, the resonant frequency of the filter may be adjusted with tuning screws that typically protrude through the housing and into each filter cavity. One such filter type is a coaxial microwave filter.

FIG. 1 is a cross-sectional view of a known coaxial microwave filter 10. The coaxial filter 10 includes a housing wall structure 12 that defines a plurality of interconnected filter cavities 13, and a filter lid 14 that is fixedly mounted to the housing wall structure 12 to cover the cavities 13. Each filter cavity 13 includes a resonator rod 16 projecting upward from a bottom wall of the housing wall structure 12, typically at the center of the cavity 13, and a tuning screw 18 mounted through the filter lid 14 opposite the resonator rod 16. The tuning screw 18 may be adjusted to extend into a bore 19 in the center of the resonator rod 16. It should be understood, however, that although only one cavity 13 is shown in FIG. 1, the filter 10 typically includes an array of cavities 13 that are interconnected through openings, such as irises, in the cavity walls. It should also be understood that a three dimensional view of the cavity 13 would show the resonator rod 16 and tuning screw 18 in the center of an open cavity 13, i.e., there is open space within the cavity 13 on all sides of the resonator rod 16.

The electrical resonance of each cavity 13 in the filter 10 is determined by the combination of the length of the resonator rod 16, the size of the cavity 13, the size of the gap 20 between the resonator rod 16 and the filter lid 14, and the insertion depth of the tuning screw 18 into the resonator rod 16. The insertion depth of the tuning screw 18 into the resonator rod 16 can, therefore, be adjusted to change the resonant frequency of the filter 10.

The resonant frequency of the filter 10 may be undesirably altered, however, by minute changes in the size of the cavity 13 resulting from thermal expansion or contraction of the housing material and the resonator rod 16 during a change in ambient temperature. This drift in frequency with temperature may be reduced by using different materials for the resonator rod 16 and the housing 12. For example, the filter lid 14 and housing wall structure 12 may be manufactured from aluminum, while the resonator rod 16 is made from some other type of metal or possibly a ceramic material. Even with such a design, however, some amount of temperature-dependant frequency drift typically remains.

SUMMARY

A microwave filter having a temperature compensating element includes a housing wall structure, a filter lid, a resonator rod, a tuning screw and the temperature compensating element. The housing wall structure defines a cavity. The filter lid closes the cavity. The resonator rod is within the cavity. The tuning screw is adjustably mounted through the filter lid and has a portion that protrudes into the cavity and is coaxial with the resonator rod. The temperature compensating element is joined to the filter lid or the housing and forms a bimetallic composite with the filter lid or housing that deforms with a change in ambient temperature.

DETAILED DESCRIPTION

Figure 1:
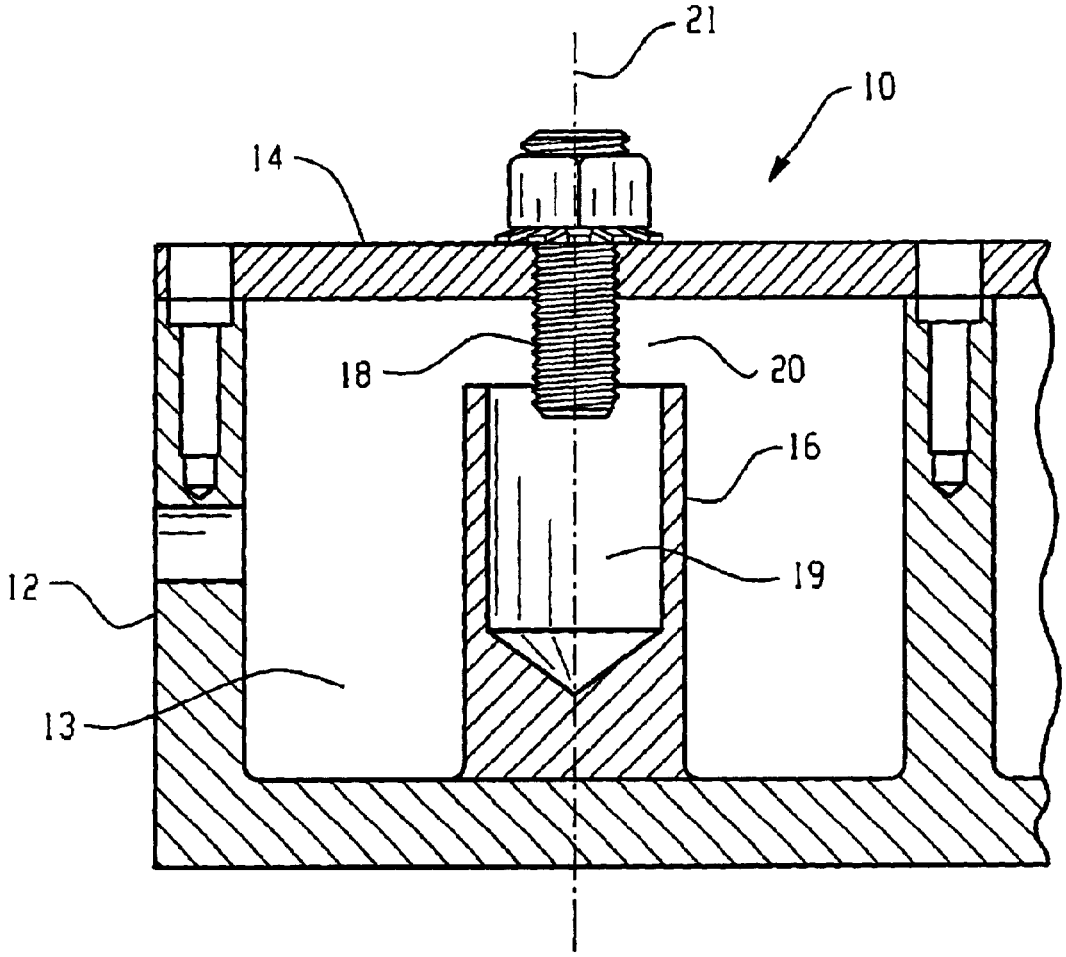
Fig. 1 (RELATED ART)
FIG. 1 is a cross-sectional view of a known coaxial microwave filter.
Figure 2:
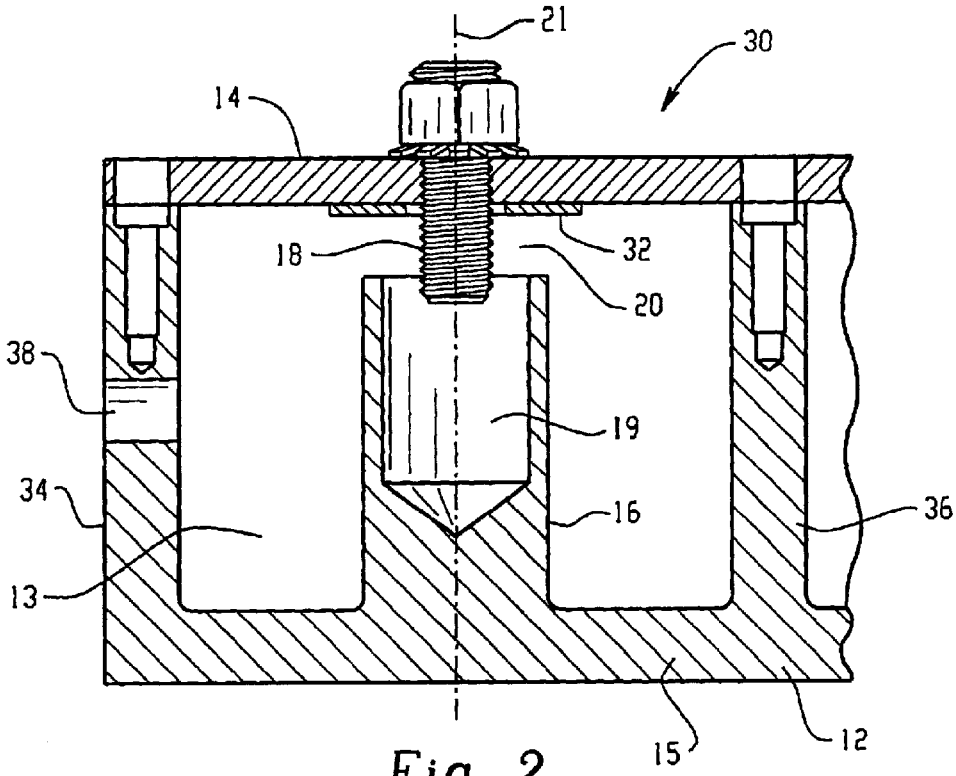
FIG. 2 is a cross-sectional view of a microwave filter having a temperature compensating element joined to an inside surface of the filter lid.

Referring now to the remaining drawing figures, FIG. 2 is a cross-sectional view of a microwave filter 30 having a temperature compensating element 32 joined to an inside surface of a filter lid 14. The filter 30 includes a housing wall structure 12, a cavity 13, the filter lid 14, a resonator rod 16, and a tuning screw 18. In addition, the filter includes the temperature compensating element 32 fixedly joined to the inner surface of the filter lid 14. Operationally, the temperature compensating element 32 causes the filter lid 14 to bow outward as the filter temperature increases, creating an equal (or substantially equal) but opposite frequency drift as that caused by the thermal expansion of the housing 12, 14. In this manner, the frequency drift caused by the temperature compensating element 32 counteracts the frequency drift caused by the thermal expansion of the housing 12, 14, thus stabilizing the filter 30.

The housing wall structure 12 preferably includes four external walls 34, and a plurality of internal walls 36 that define a plurality of cavities 13 within the housing wall structure 12. The cavities 13 are preferably covered by the filter lid 14 which is fixedly mounted to the top of the housing wall structure 12. The cavities 13 are preferably interconnected in an array by openings or irises (not shown) within the internal walls 36 of the housing wall structure 12 in order to form a continuous path between an input port (not shown) and an output port 38

The resonator rod 16 projects upward from a bottom wall 15 of the housing wall structure 12, preferably with one resonator rod 16 at the center of each cavity 13. The tuning screw 18 is adjustably mounted through the filter lid 14 opposite the resonator rod 16, and is received in a bore 19 in the top of the resonator rod 16. Preferably, the tuning screw 18 mates with a screw-thread in a bore extending through the filter lid 14 along an axis 21, and may be adjusted to a desired depth within the bore 19. In a preferred embodiment, the filter 30 includes a tuning screw 18 corresponding to each resonator rod 16, but in other embodiments some resonator rods 16 could have a fixed resonant frequency.

Together, each cavity 13, resonator rod 16 and tuning screw 18 in the filter 30 forms a resonator having a resonant frequency. The resonator rod 16 and cavity 13 can be represented electrically as a transmission line short-circuited at one end. The gap 20 between the end of the resonator rod 16 and the filter lid 14 can then be represented electrically as a capacitance connected to the other end of the transmission line. The parallel combination of the transmission line and capacitance results in an electrically resonant structure at microwave frequencies. The tuning screw 18 thus enables the resonant frequency of each cavity 13 to be changed by varying the capacitance.

The temperature compensating element 32 is preferably a ring-shaped disc or washer joined to the inner surface of the filter lid 14, preferably with one temperature compensating element 32 joined to the filter lid 14 coaxially with each tuning screw 18. The temperature compensating element 32 is preferably soldered to the filter lid 14, but may also be joined by other means such as welding. The temperature compensating element 32 is manufactured from a material with a different thermal expansivity (thermal expansion coefficient) than the filter lid 14 material to which it is joined, thus forming a bimetallic composite. Preferably, the filter lid 14, housing wall structure 12, and resonator rod 16 are manufactured from aluminum with a finish of silver and an undercoat of nickel, and the temperature compensating element 32 is manufactured from steel with a finish of silver and an undercoat of copper. Different materials may be used in other embodiments, however, so long as the thermal expansivity (thermal expansion coefficient) of the temperature compensating element 32 is lower than the thermal expansivity of the filter lid 14.

Metals with different thermal expansion coefficients expand or contract by different amounts as the ambient temperature is changed. For instance, as temperature increases, a metal with a higher thermal expansivity will expand to a greater size than a metal with a lesser thermal expansivity. When two such metals are joined, the different thermal expansion coefficients will cause the bimetallic composite to bend as the ambient temperature is increased. Thus, joining a temperature compensating element 32 with a lower thermal expansivity to the inner surface of a filter lid 14 with a higher thermal expansivity causes the filter lid 14 to bow outward (deform away from the resonator rod 16) as the filter's ambient temperature is increased.

As the filter lid 14 around the tuning screw 18 bows outward with an increase in ambient temperature, the depth of the tuning screw 18 insertion into the resonator rod bore 19 is decreased, thus decreasing the end capacitance of the resonator. This decrease in capacitance results in an increase in the resonant frequency of the cavity 13, or a positive frequency drift. In contrast, a cavity 13 formed from an aluminum housing 12, 14 has a negative frequency drift as temperature is increased. Thus, by varying the size and thickness of the temperature compensating element 32 to control the amount of bow and resulting change in capacitance, the positive frequency drift can be calibrated to match the negative frequency drift of the resonator and stabilize the filter 30.

Similarly, as the ambient temperature decreases, the temperature compensating element 32 and filter lid 14 contract to different sizes, thus increasing the insertion depth of the tuning screw 18 and the capacitance of the resonator. The increased capacitance results in a negative frequency drift that compensates for the positive frequency drift caused by the contraction of the housing 12, 14.

Figure 2A:
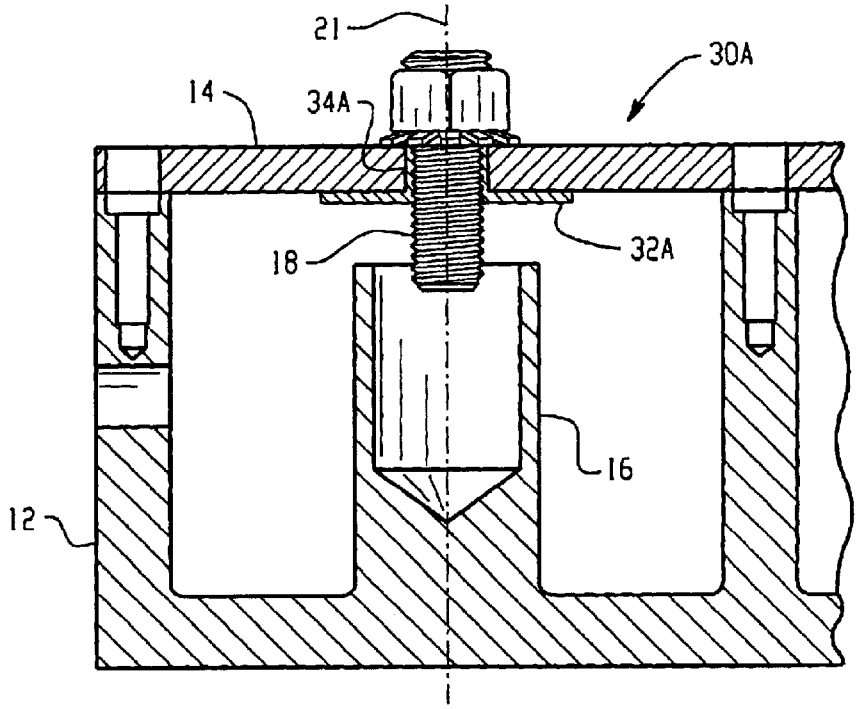
FIG. 2A is an alternative embodiment of the microwave filter shown in FIG. 2 in which the temperature compensating element has a cylindrical neck portion with a screw-threaded bore for receiving the tuning screw.

FIG. 2A is an alternative embodiment 30A of the microwave filter 30 shown in FIG. 2 in which the temperature compensating element 32A has a cylindrical neck portion 34A with a screw-threaded bore for receiving the tuning screw 18. In the embodiment 30 shown in FIG. 2, the tuning screw 18 is received in a threaded bore through the filter lid 14. In this alternative embodiment 30A, however, the temperature compensating element 32A protrudes though the bore in the filter lid 14 and has the screw-thread that receives the tuning screw 18.

Figure 3:
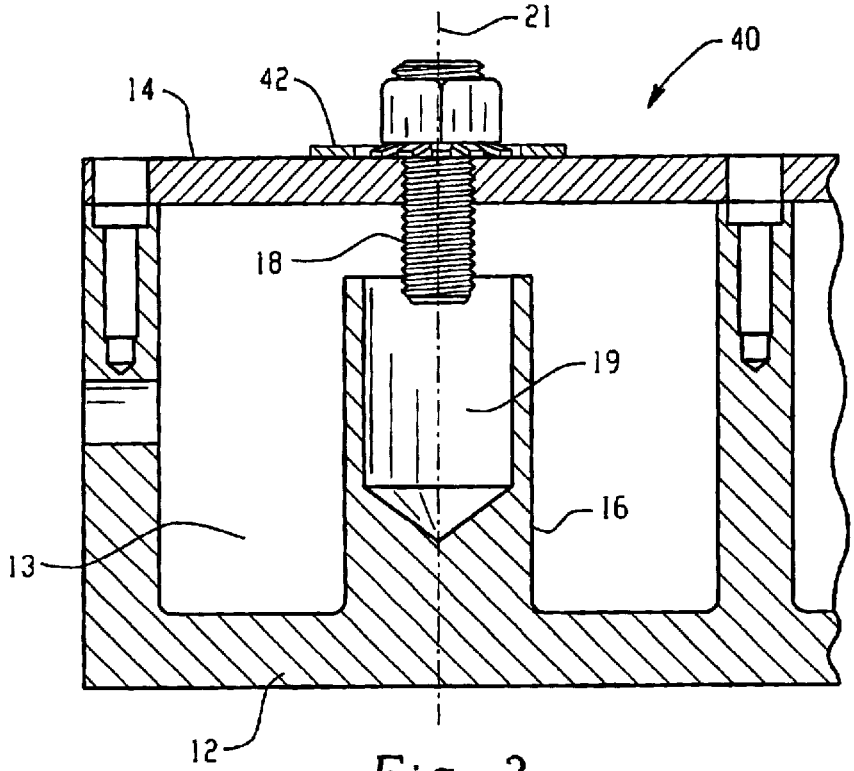
FIG. 3 is a cross-sectional view of a microwave filter having a temperature compensating element joined to an outside surface of the filter lid.

FIG. 3 is a cross-sectional view of a microwave filter 40 having a temperature compensating element 42 joined to an outside surface of the filter lid 14. This filter 40 is similar to the microwave filter 30 described above with reference to FIG. 2, except the temperature compensating element 42 is joined to the outside of the filter lid 14, and is manufactured from a material having a higher thermal expansivity than the filter lid 14. When the temperature compensating element 42 is made from a material having a higher thermal expansivity than the filter lid 14, the temperature compensating element 42 should be joined to the outside of the filter lid 14 in order to cause the filter lid 14 to bow outwards (away from the resonator rod 16) as ambient temperature is increased. With the temperature compensating element 42 joined to the outside of the filter lid 14, the resulting bimetallic composite operates to stabilize the filter 40 in the same manner as the embodiment 30 described above with reference to FIG. 2.

Figure 3A:
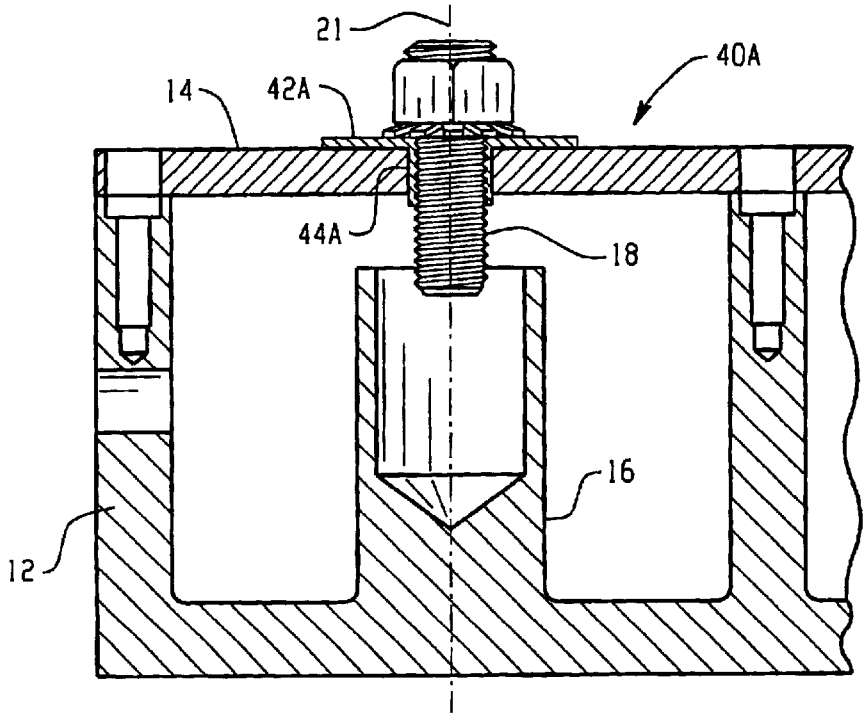
FIG. 3A is an alternative embodiment of the microwave filter shown in FIG. 3 in which the temperature compensating element has a cylindrical neck portion with a screw-threaded bore for receiving the tuning screw.

FIG. 3A is an alternative embodiment 40A of the microwave filter 40 shown in FIG. 3 in which the temperature compensating element 42A has a cylindrical neck portion 44A with a screw-threaded bore for receiving the tuning screw 18. In this alternative embodiment 40A, the temperature compensating element 42A protrudes through the bore in the filter lid 14 and has the screw-thread that receives the tuning screw 18.

Figure 4:
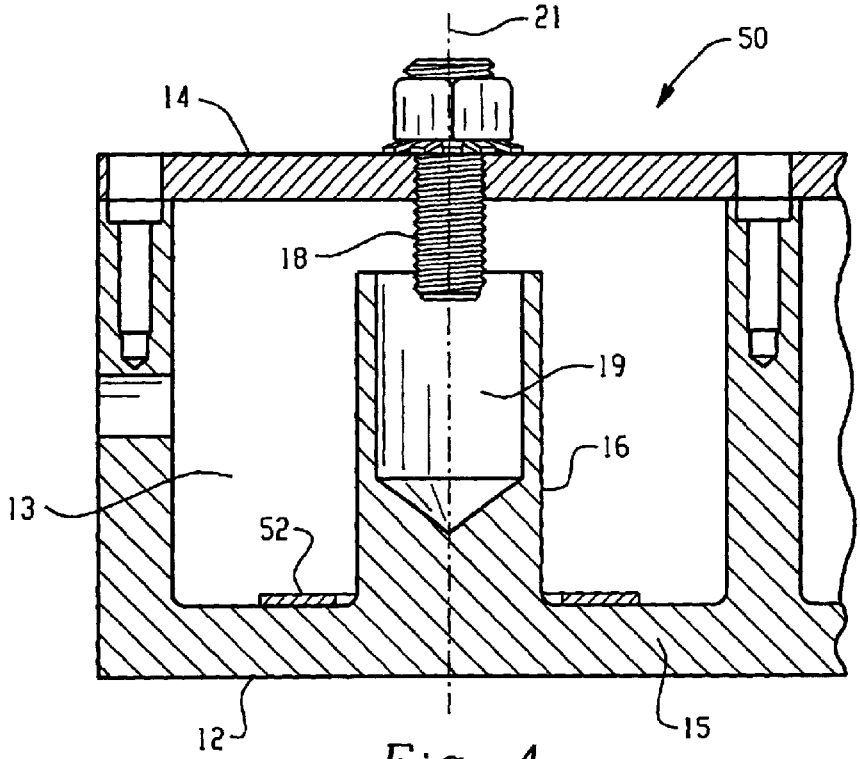
FIG. 4 is a cross-sectional view of a microwave filter having a temperature compensating element joined to an inside surface of the floor of the housing.

FIG. 4 is a cross-sectional view of a microwave filter 50 having a temperature compensating element 52 joined to an inside surface of the bottom wall 15 of the housing wall structure 12. This filter 50 is similar to the microwave filter 30 described above with reference to FIG. 2, except the temperature compensating element 52 is joined to an inside surface of the bottom wall 15, preferably with one temperature compensating element 52 joined to the bottom wall 15 coaxially with each resonator rod 16. The thermal expansivity of the temperature compensating element 52 is lower than that of the housing wall structure 12. Thus, the bimetallic composite formed from the joinder of the temperature compensating element 52 and the bottom wall 15 causes the housing wall structure 12 to bow outward (away from the filter lid 14) as the filter's ambient temperature is increased. As the bottom wall 15 bows outward, the attached resonator rod 16 is moved away from the tuning screw 18, thus decreasing the insertion depth of the tuning screw 18 and the end capacitance of the resonator. Similar to the embodiments described above with reference to FIGS. 2 and 3, the resultant decrease in capacitance results in an increase in the resonant frequency of the cavity 13, or a positive frequency drift. The positive frequency drift caused by the bimetallic composite may be calibrated by adjusting the size and thickness of the temperature compensating element 52 in order to compensate for the negative frequency drift of the resonator and stabilize the filter 50.

Figure 5:
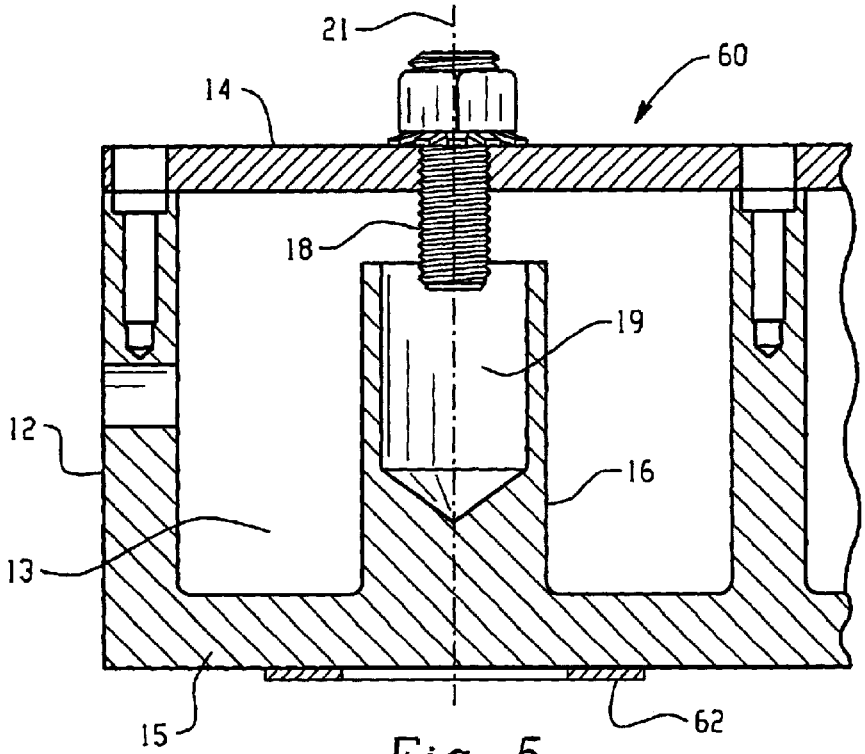
FIG. 5 is a cross-sectional view of a microwave filter having an temperature compensating element joined to an outside surface of the floor of the housing.

FIG. 5 is a cross-sectional view of a microwave filter 60 having a temperature compensating element 62 joined to an outside surface of the bottom wall 15 of the housing wall structure 12. This filter 60 is similar to the microwave filter 50 described above with reference to FIG. 4, except the temperature compensating element 62 is joined to the outside of the bottom wall 15, and is manufactured from a material having a higher thermal expansivity than the housing wall structure 12. When the temperature compensating element 62 is made from a material having a higher thermal expansivity than the bottom wall 15, the temperature compensating element 62 should be joined to the outside of the bottom wall 15 in order to cause the housing wall structure 12 to bow outwards (away from the filter lid 14) as ambient temperature is increased. With the temperature compensating element 62 joined to the outside of the bottom wall 15, the resulting bimetallic composite operates to stabilize the filter 60 in the same manner as the embodiment 50 described above with reference to FIG. 4.

Figure 6:
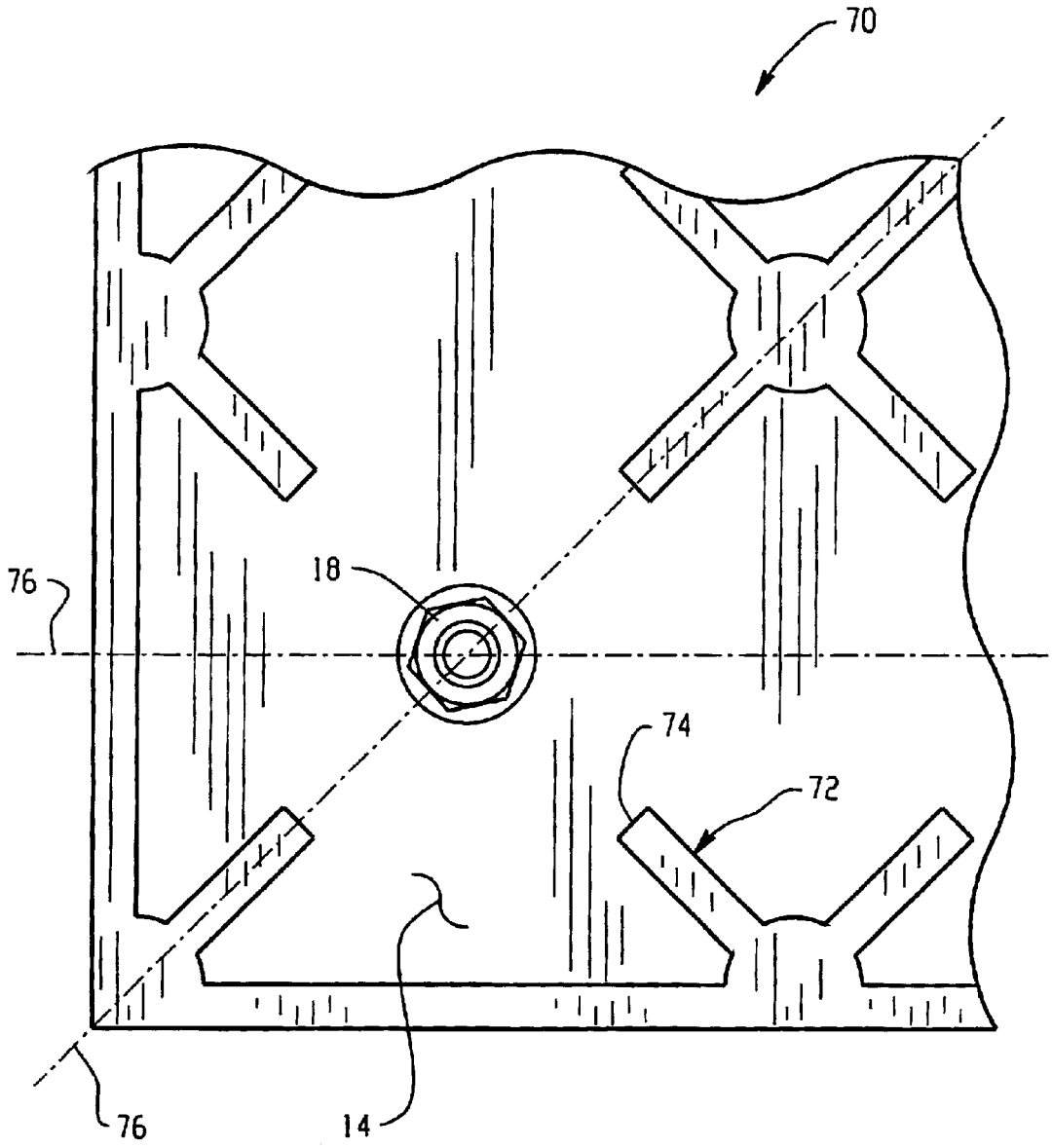
FIG. 6 is a top view of a microwave filter having temperature compensating elements that project inward from the four corners of the cavity.

FIG. 6 is a top view of a microwave filter 70 having temperature compensating elements 72 that project inward from the four corners of the cavity 13. This microwave filter 70 is structurally similar to the filters described above with reference to FIGS. 2–5, except this embodiment 70 includes a plurality of temperature compensating elements 72 that are mounted along radial axes 76 extending from the center of the tuning screw 18 or resonator rod 16. In the embodiment shown, the temperature compensating elements 72 are rectangular and are mounted on the outer surface of the filter lid 14. In other embodiments, however, the temperature compensating elements 72 may be joined to either the inner surface of the filter lid 14, the inner surface of the bottom wall 15 or the outer surface of the bottom wall 15, depending upon the thermal expansivity of the temperature compensating elements 72. In addition, other embodiments may include differently shaped temperature compensating elements 72, or may include temperature compensating elements 72 that project inward from the cavity walls instead of from the corners.

In the microwave filter 70 shown in FIG. 6, the temperature compensating elements 72 joined to the outside of the filter lid 14 should have a lower thermal expansivity than the filter lid 14 in order to create a positive frequency drift with an increase in temperature. As the ambient temperature of the filter 70 increases, the bimetallic composites formed from the plurality of temperature compensating elements 72 and the filter lid 14 cause the portion of the filter lid 14 relative to the tuning screw 18 to bow outward (deform away from the bottom wall 15), thereby decreasing the insertion depth of the tuning screw 18 into the resonator rod 16 and increasing the resonant frequency. Similar to the various embodiments described above, the dimensions of the temperature compensating elements can be calibrated such that the positive frequency drift with increased temperature caused by the temperature compensating elements 72 counteracts the negative frequency drift of the resonator.

In an alternative embodiment in which the temperature compensating elements 72 are joined to the inner surface of the filter lid 14, the temperature compensating elements 72 should have a higher thermal expansivity than the filter lid 14 in order to achieve the desired positive frequency drift. Similarly, if the temperature compensating elements 72 are joined to the outer surface of the bottom wall 15, then the thermal expansivity should be lower than that of the housing wall structure 12; and if the temperature compensating elements 72 are joined to the inner surface of the bottom wall 15, then the thermal expansivity should be higher than that of the housing wall structure 12.

This written description uses examples to disclose the invention, including the best mode, and also to enable any person skilled in the art to make and use the invention. The patentable scope of the invention is defined by the claims, and may include other examples that occur to those skilled in the art.

We claim:

1. A microwave filter, comprising:

a housing wall structure defining a cavity and having a bottom wall;

a filter lid closing the cavity;

a resonator rod within the cavity and projecting from the bottom wall;

a tuning screw adjustably mounted through the filter lid and having a portion that protrudes into the cavity and is coaxial with the resonator rod; and a temperature compensating element joined to the bottom wall and coaxial with the resonator rod.

2. The microwave filter of claim 1, wherein the temperature compensating element is joined to an inner surface of the bottom wall and has a lower thermal expansion coefficient than the bottom wall.

3. The microwave filter of claim 2, wherein the temperature compensating element is steel and the bottom wall is aluminum.

4. The microwave filter of claim 2, wherein the temperature compensating element is steel with a finish of silver and an undercoat of copper, and wherein the bottom wall is aluminum with a finish of silver and an undercoat of nickel.

5. The microwave filter of claim 1, wherein the temperature compensating element is joined to an outer surface of the bottom wall and has a higher thermal expansion coefficient than the bottom wall.

6. The microwave filter of claim 1, wherein the temperature compensating element is soldered to the bottom wall.

7. The microwave filter of claim 1, wherein the temperature compensating element is welded to the bottom wall.

8. The microwave filter of claim 1, wherein the temperature compensating element causes the bottom wall to bow outward with an increase in ambient temperature.

9. The microwave filter of claim 1, wherein a screw-threaded bore is defined by the filter lid, and wherein the tuning screw mates with the screw-threaded bore.

10. The microwave filter of claim 1, wherein the housing wall structure defines a plurality of interconnected cavities.

11. The microwave filter of claim 1, wherein the resonator rod defines a bore, and wherein the portion of the tuning screw that protrudes into the cavity is adjustably received in the bore.

12. The microwave filter of claim 1, wherein the dimensions of the temperature compensating element are chosen to create a positive frequency drift with an increase in ambient temperature that is equal to or substantially equal to a negative frequency drift caused by thermal expansion of the filter lid and the housing wall structure.

* * * * *